US007034763B2

(12) United States Patent
Wang et al.

(10) Patent No.: US 7,034,763 B2
(45) Date of Patent: Apr. 25, 2006

(54) MINIATURIZED CPW-FED SLOT ANTENNA WITH DUAL-FREQUENCY OPERATION

(75) Inventors: Chien-Jen Wang, No. 404, Ba-De Rd., Feng-Sun City, Kaoshiong Hsien (TW); Jin-Jei Li, Yung-Kang (TW)

(73) Assignee: Chien-Jen Wang, Kaoshiong Hsien (TW)

( * ) Notice: Subject to any disclaimer, the term of this patent is extended or adjusted under 35 U.S.C. 154(b) by 0 days.

(21) Appl. No.: 10/902,863

(22) Filed: Aug. 2, 2004

(65) Prior Publication Data

US 2006/0050002 A1 Mar. 9, 2006

(30) Foreign Application Priority Data

Aug. 8, 2003 (TW) ..... 92121885 A

(51) Int. Cl.
*H01Q 13/10* (2006.01)

(52) U.S. Cl. ..... 343/767; 343/700 MS; 343/770; 343/742

(58) Field of Classification Search ..... 343/767
See application file for complete search history.

(56) References Cited

U.S. PATENT DOCUMENTS 6,278,410 B1 * 8/2001 Soliman et al. ..... 343/769
2001/0050651 A1 * 12/2001 Grangeat et al. ..... 343/767

* cited by examiner

*Primary Examiner*—Trinh Vo Dinh
(74) *Attorney, Agent, or Firm*—Rosenberg, Klein & Lee

(57) ABSTRACT

A slot antenna includes a substrate with a metal ground plate on one side thereof and a plurality of rectangular slots are etched in an inner periphery of the ground plate. An opening is defined in one side of the ground plate and a metal feedline is located on the substrate and located close to the opening. The feedline includes a plurality of sub-sections extending within the slot and at least two matching stubs are formed on the feedline and a sub-ground plate is connected to the ground plate and located in the slot. A plurality of metal floating stubs are attached to the rear side of the substrate. When viewing from the front side of the substrate, the floating stubs are connected across the ground plate and at least one of the matching stubs. The antenna is miniaturized and includes dual-frequency operation.

6 Claims, 11 Drawing Sheets

MINIATURIZED CPW-FED SLOT ANTENNA WITH DUAL-FREQUENCY OPERATION

FIELD OF THE INVENTION

The present invention relates to a miniaturized CPW-fed slot antenna with dual-frequency operation and achieves a purpose of miniaturized size with dual-frequency operation and enhancement of bandwidth.

BACKGROUND OF THE INVENTION

With the repaid development of wireless communication systems, the radiating antennas with low cost and dual-band operation are in demand for various applications, such as wireless local area network (WLAN). The WLAN systems unitize the unlicensed bands, the ISM band at 2.4 GHz and 5.2 GHz only for the industrial, scientific and medical applications, to reduce the cost of the network building. The slot antenna has been investigated since the 1940s and many research studies have discussed the feeding structure, the bandwidth characteristics and the radiation phenomenon. The slot is etched on the ground plane of the substrate and radiation from both sides of the substrate is achieved by a microstrip or CPW-fed in a resonator cavity. In order to derive the maximum beam at the broadside direction, the length of the slot antenna should be limited to one wavelength. The technology of applying two different slot loops in the aperture was proposed to create dual bands. FIG. 12 shows a conventional slot antenna comprising a plurality of etched slots 62 in the ground plate 61 of the substrate 60 and a sub-antenna 64 extends from the ground plate 61 and to the opening 63 of the slot 62 so as to be the signal feedline. Another conventional slot antenna is disclosed in FIG. 13 and the slot 72 is etched as a T-shaped slot in the ground plate 71 of the substrate 70. A T-shaped feedline 73 is located in the inner periphery of the slot 72. Nevertheless, none of the conventional slot antennas is satisfied.

The present invention intends to provide the CPW-fed slot antenna to perform the dual-band characteristic and miniaturize the slot size utilizing the E-like feeding structure and adding the matching stub at the slot edge and four floating patches on the backside of the substrate. According to the measured results, the bandwidth of the lower resonant frequency distributes from 2.38 GHz to 2.60 GHz and one of higher resonant frequency ranges from 5.13 GHz to 5.73 GHz. The above techniques are effective and realizable for the design of the CPW-fed slot antenna.

SUMMARY OF THE INVENTION

The present invention relates to a miniaturized CPW-fed slot antenna which includes a substrate with a metal ground plate on one side thereof and an opening is defined in one side of the ground plate and a metal feedline is connected on the base and located close to the opening. A plurality of rectangular slots is etched in an inner periphery of the ground plate. The feedline includes a plurality of sub-sections extending within the slot and at least two matching stubs are formed on the feedline. A sub-ground plate is connected to the ground plate and located in the slot. A plurality of metal floating stubs is attached to the rear side of the substrate. When viewing from the front side of the substrate, the floating stubs are connected across the ground plate and at lest one of the matching stubs. The antenna is miniaturized and includes dual-frequency operation.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
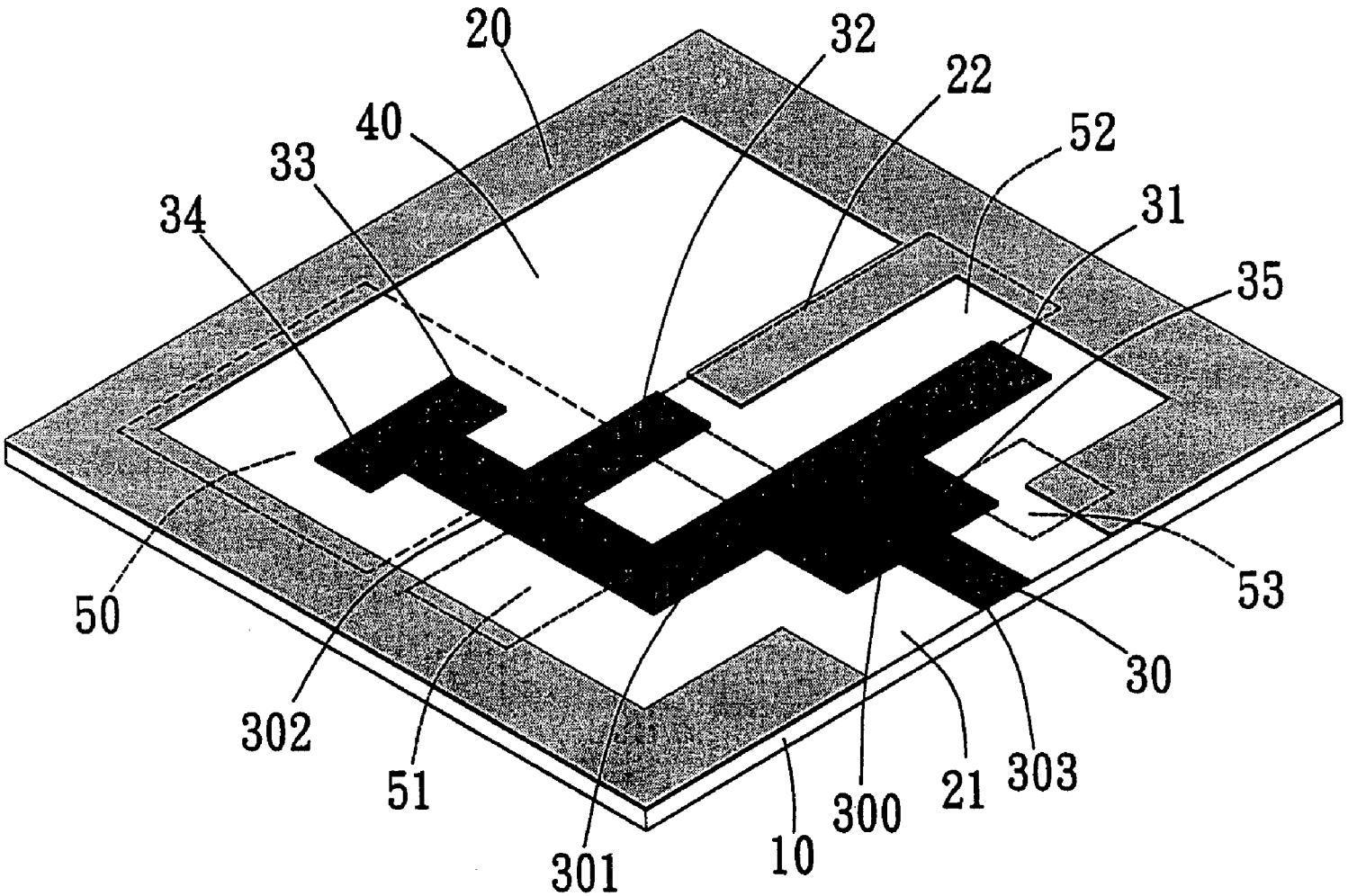
FIG. 1 is a perspective view of the slot antenna of the present invention.
Figure 2:
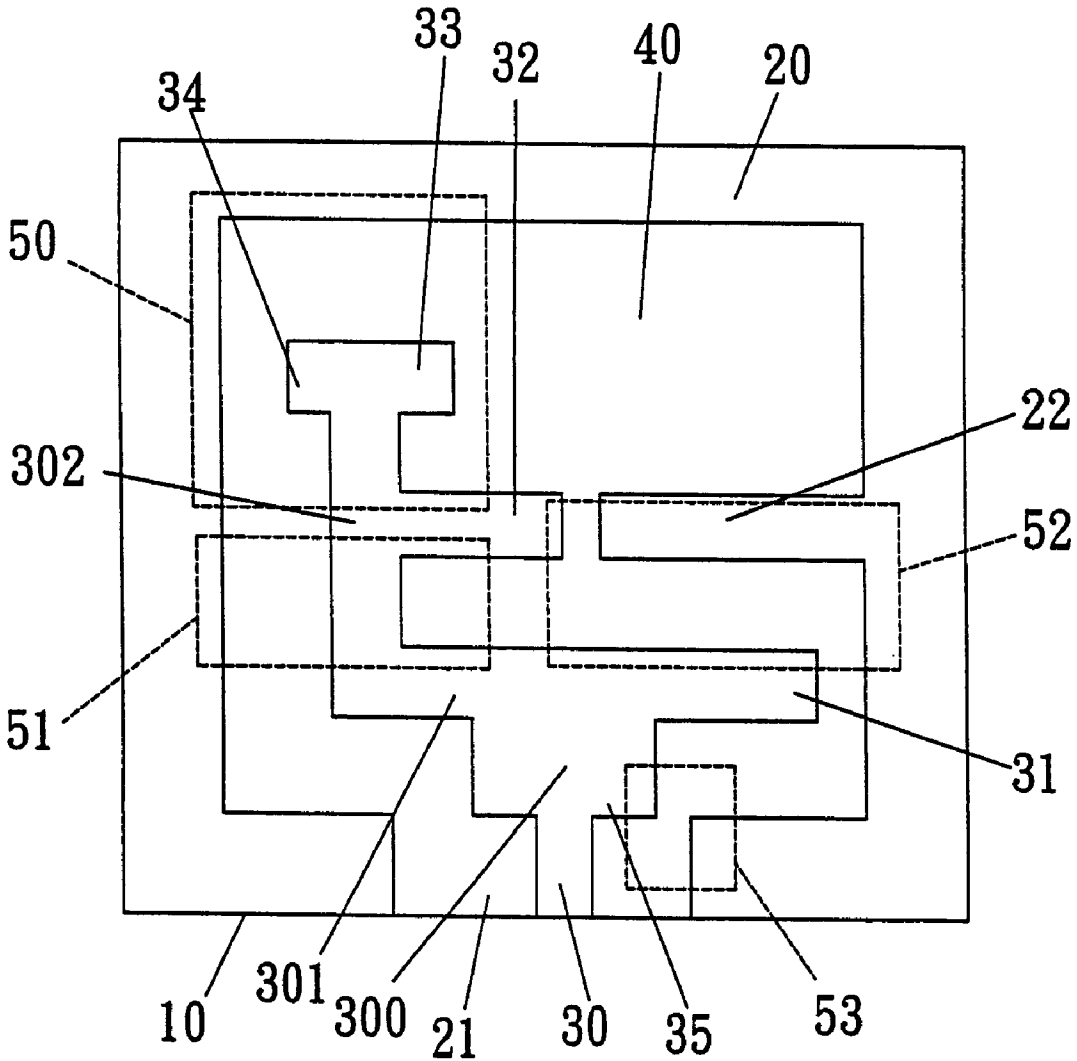
FIG. 2 shows a front view of the slot antenna of the present invention.
Figure 3:
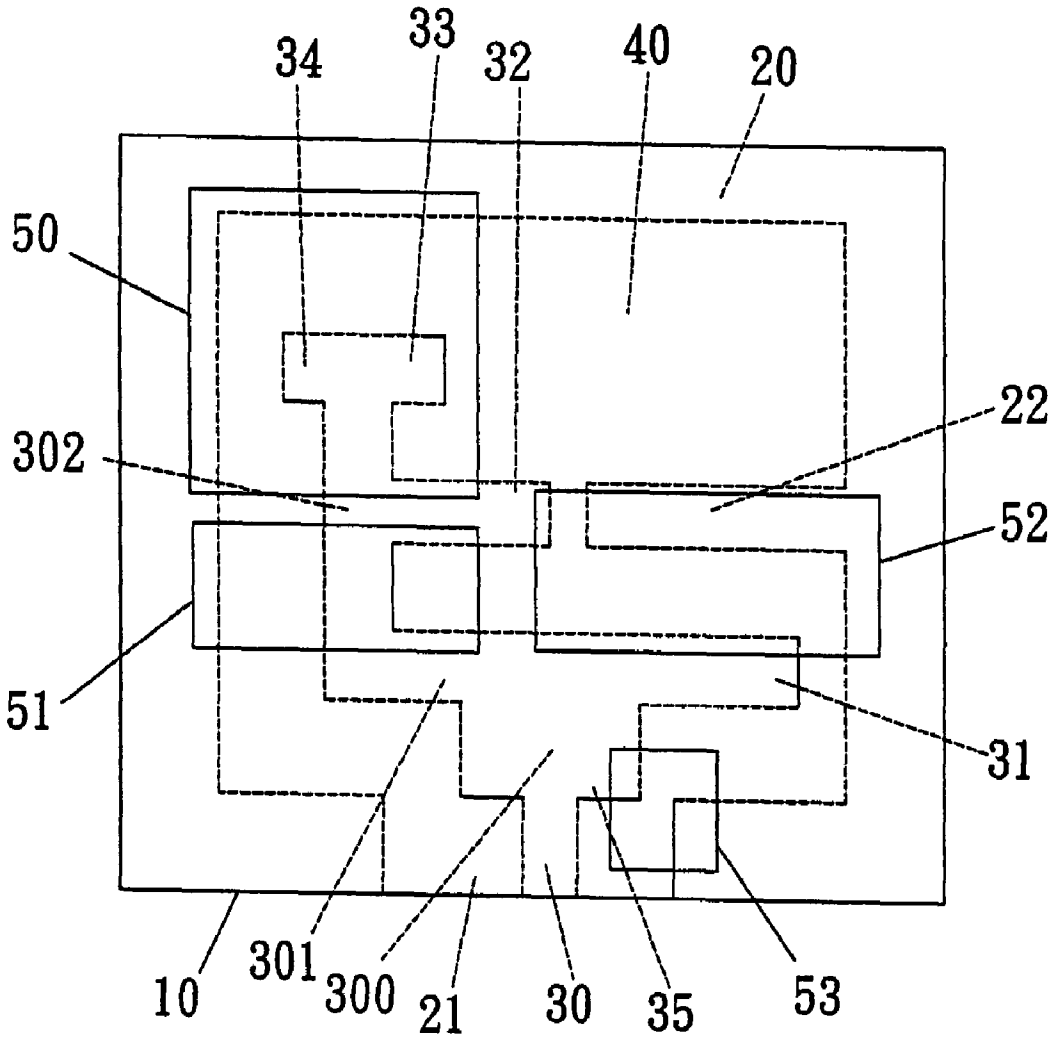
FIG. 3 shows a rear view of the slot antenna of the present invention.

Referring to FIGS. 1 to 3, the slot antenna of the present invention comprises a substrate 10 with a metal ground plate 20 on one side thereof and a plurality of rectangular slots 40 are etched in an inner periphery of the ground plate 20. An opening 21 is defined in one side of the ground plate 20 and a metal feedline 30 is connected on the substrate 10 and located close to the opening 21. The feedline 30 includes a plurality of sub-sections extending within the slot 40. At least two matching stubs 31, 32, 33 are formed on the feedline 30 and a sub-ground plate 22 is connected to the ground plate 20 and located in the slot 40. A plurality of metal floating stubs 50, 51, 52, 53 are attached to the rear side of the substrate 10. When viewing from the front side of the substrate 10, the projection of the floating stubs 50, 51, 52 and 53 are connected across the ground plate 20 and at lest one of the matching stubs 31, 32, 33 of the feedline 30. By utilizing the matching stubs 31, 32, 33 and the floating stubs 50, 51, 52 and 53 on the rear side of the substrate 10, the antenna can be miniaturized and includes dual-frequency operation.

In the first embodiment of the present invention, the feedline 30 includes three sections, wherein the second section 301 is located at negative 90 degrees (counter clockwise) relative to the first section 300, and the third section 302 is located at positive 90 degrees (clockwise) relative to the second section 301. The first matching stub 31 extends from the bending portion of the beginning point 303 of the feedline 30. The second matching stub 32 extends from the third section 302 and the third matching stub 33 extends from the distal end of the third section 302. A gap is defined between the sub-ground plate 22 and the third section 302.

Another embodiment of the present invention further includes a fourth matching stub 34 extending from the distal end of the third section 302 and located in opposite to the third matching stub 33.

A large area of metal plate 35 is disposed on the conjunction portion of the first section 300 and second section 301 so as to be used as an impedance transformer to reduce the frequency and increase the efficiency of the antenna. The floating stub 53 is attached to the rear side of the substrate 10, and When viewing from the front side of the substrate 10, the projection of the floating stub 53 is connected across the ground plate 20 and the metal plate 35.

There can be four floating stubs 50, 51, 52 and 53 attached on the rear side of the substrate 10. When viewed from the front side of the substrate 10, the projection of the first floating stub 50 is connected across the second, the third, the fourth matching stubs 32, 33, 34 and the ground plate 20. The projection of the second floating stub 51 is connected across the second matching stub 32, the second and third sections 301, 302 and the ground plate 20. The projection of the third floating stub 52 is connected across the first and second matching stubs 31, 32, the sub-ground plate 22 and the ground plate 20.

The miniaturized CPW-fed slot antenna of the present invention is fabricated by using FR-4 glassfiber as the substrate 10 with the dielectric constant of 4.4. A ground plate 20 is connected on the substrate 10 and a rectangular slot 40 whose dimension was 20×20 mm2 is etched in the ground plate 20 which is used as the radiating element. The width W=20 mm of the slot 40 is determined to be about 0.3 times of the length of wave at 2.4 GHz. FIGS. 1 and 2 show the feedline 30 in the slot 40. It is noted that the width of a conventional slot is about 0.5 times of the length of wave and only 0.3 times of the length of wave is required for the slot of the present invention. The area required is reduced up to 40%.

Figure 4:
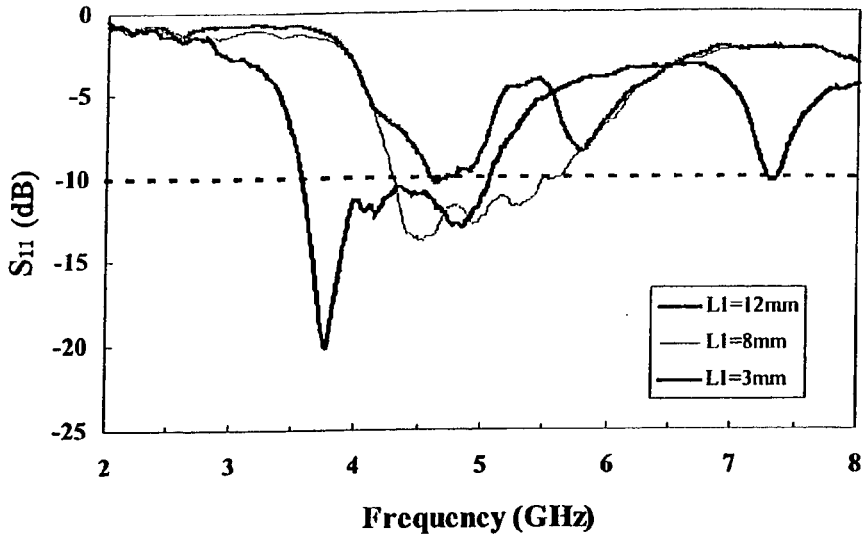
FIG. 4 shows the comparison of the reflection coefficients of different L1.
Figure 5:
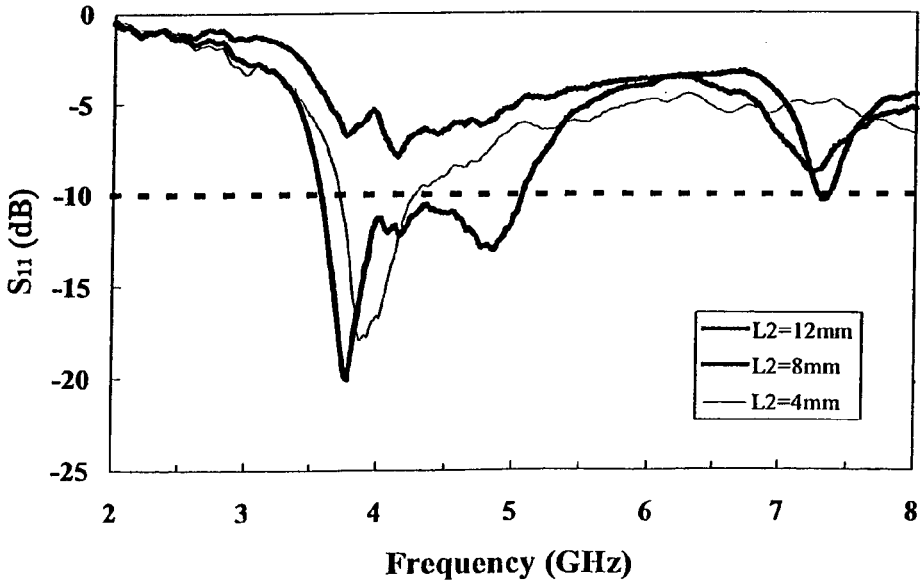
FIG. 5 shows the comparison of the reflection coefficients of different L2.

The measured reflection coefficient S11 of the CPW-fed slot antenna is observed by utilizing a vector network analyzer. FIG. 4 presents the comparison of the measured reflection coefficient S11 versus the frequency for the various lengths L1 of the third matching stubs. When shortening the length L1, the bandwidth is expanded and the radiation efficiency is enhanced. FIG. 5 shows the comparison of the measured reflection coefficient S11 of the proposed slot antenna by changing the length L2 of the second matching stub. The optimal lengths of L1 and L2 are 3 mm and 8 mm, empirically.

Figure 6:
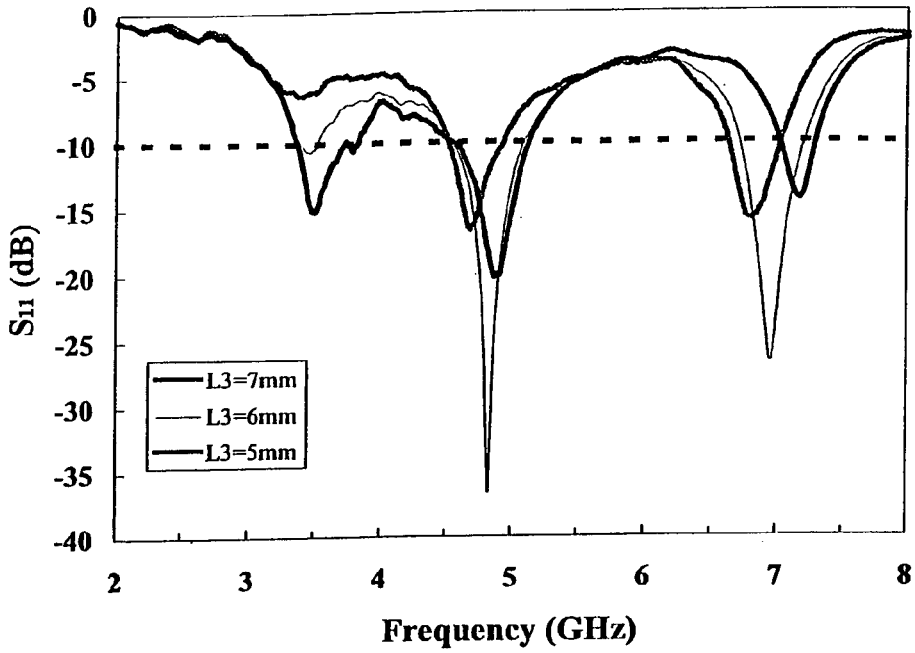
FIG. 6 shows the comparison of the reflection coefficients of different L3 of the third matching stubs of the feedline.

FIG. 6 shows that the optimal length L3 of the sub-ground plate 22 is 5 mm after comparison between the test results of the length of 7 mm, 6 mm and 5 mm.

Figure 7:
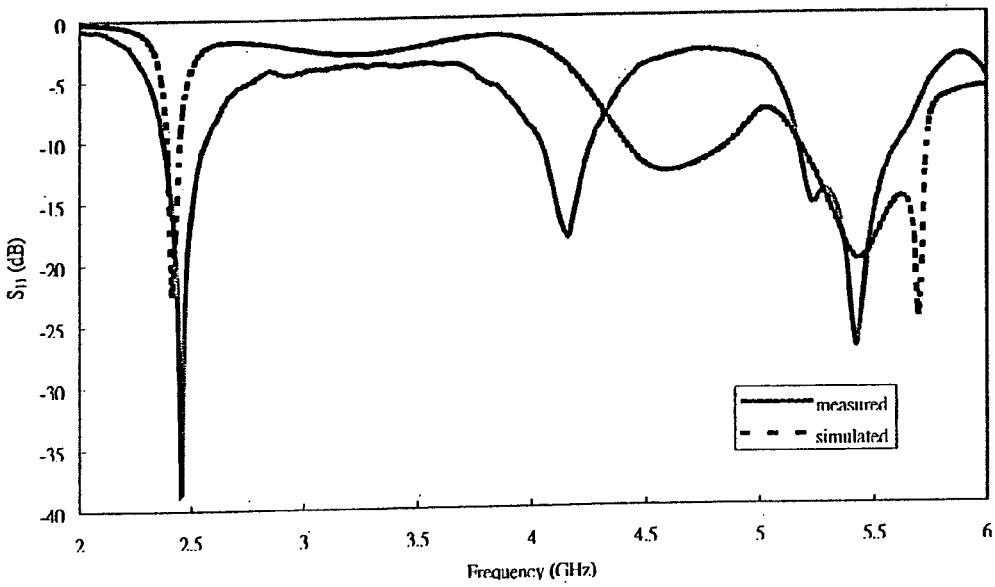
FIG. 7 shows the result of the substrate with metal stubs attached on a rear side of the substrate and the feedline having a fourth matching stubs connected to a distal end of the third section thereof.

FIG. 7 shows the comparison between the base 10 having floating stubs 50, 51, 52 and 53 attached on the rear side thereof and the feelline 30 having the fourth matching stub 34 connected to the third section 302 of the feedline 30. It shows that the use of the floating stubs 50, 51, 52 and 53 and the fourth matching stub 34 decreases the initial frequency and expand the bandwidth of the dual-frequency.

Figure 8:
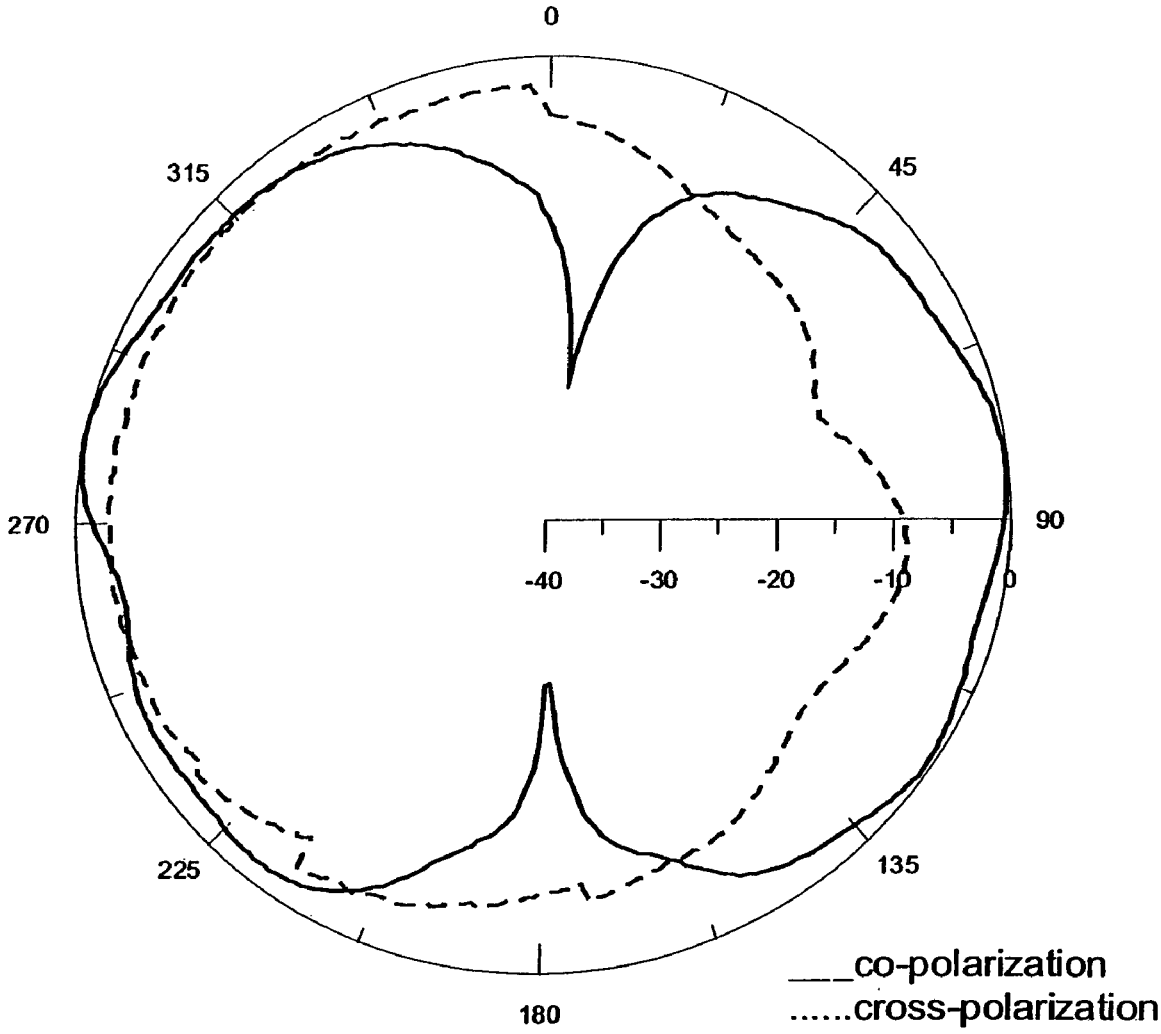
FIG. 8 shows the radiation diagram on XZ plane at 2.45 GHz.
Figure 9:
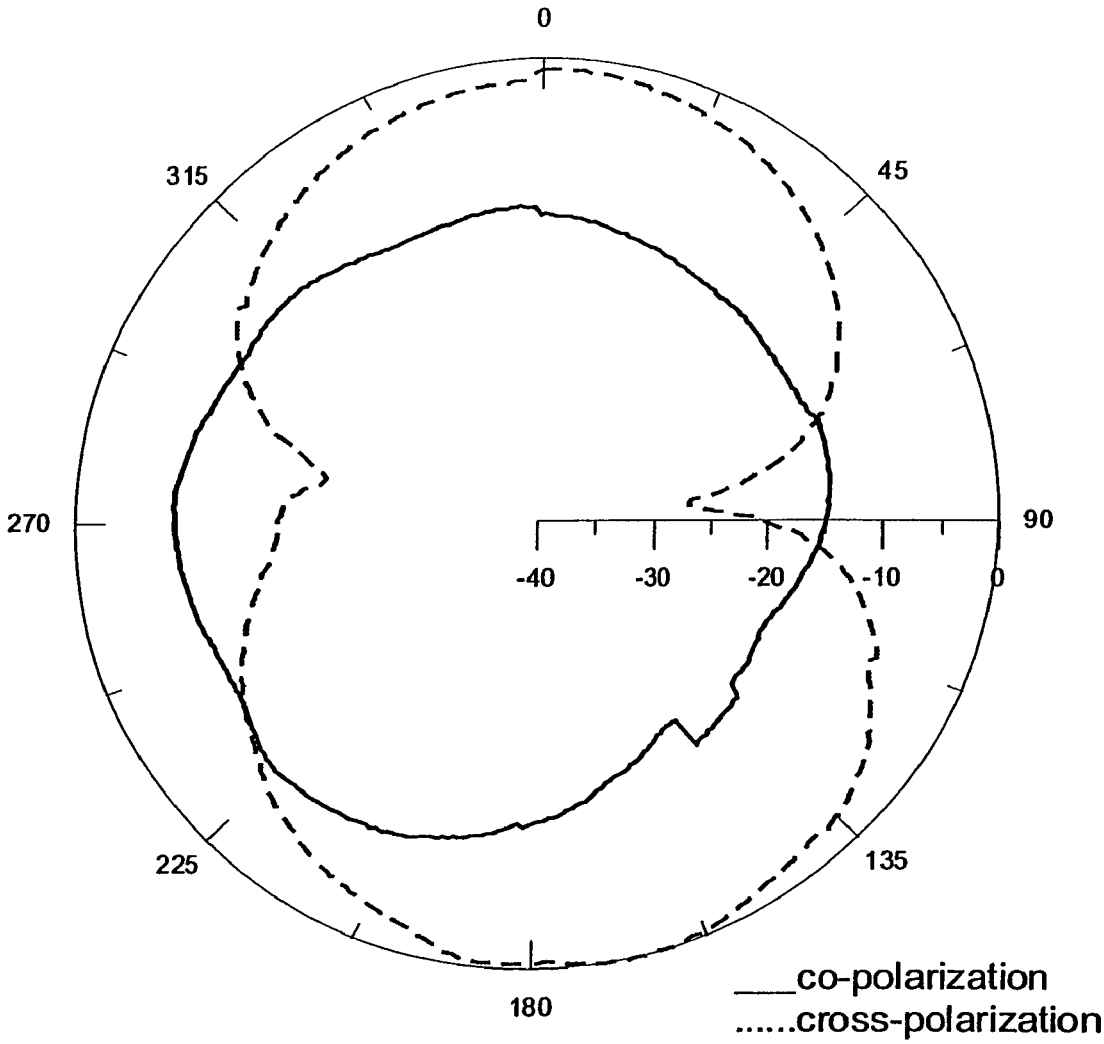
FIG. 9 shows the radiation diagram on XY plane at 2.45 GHz.
Figure 10:
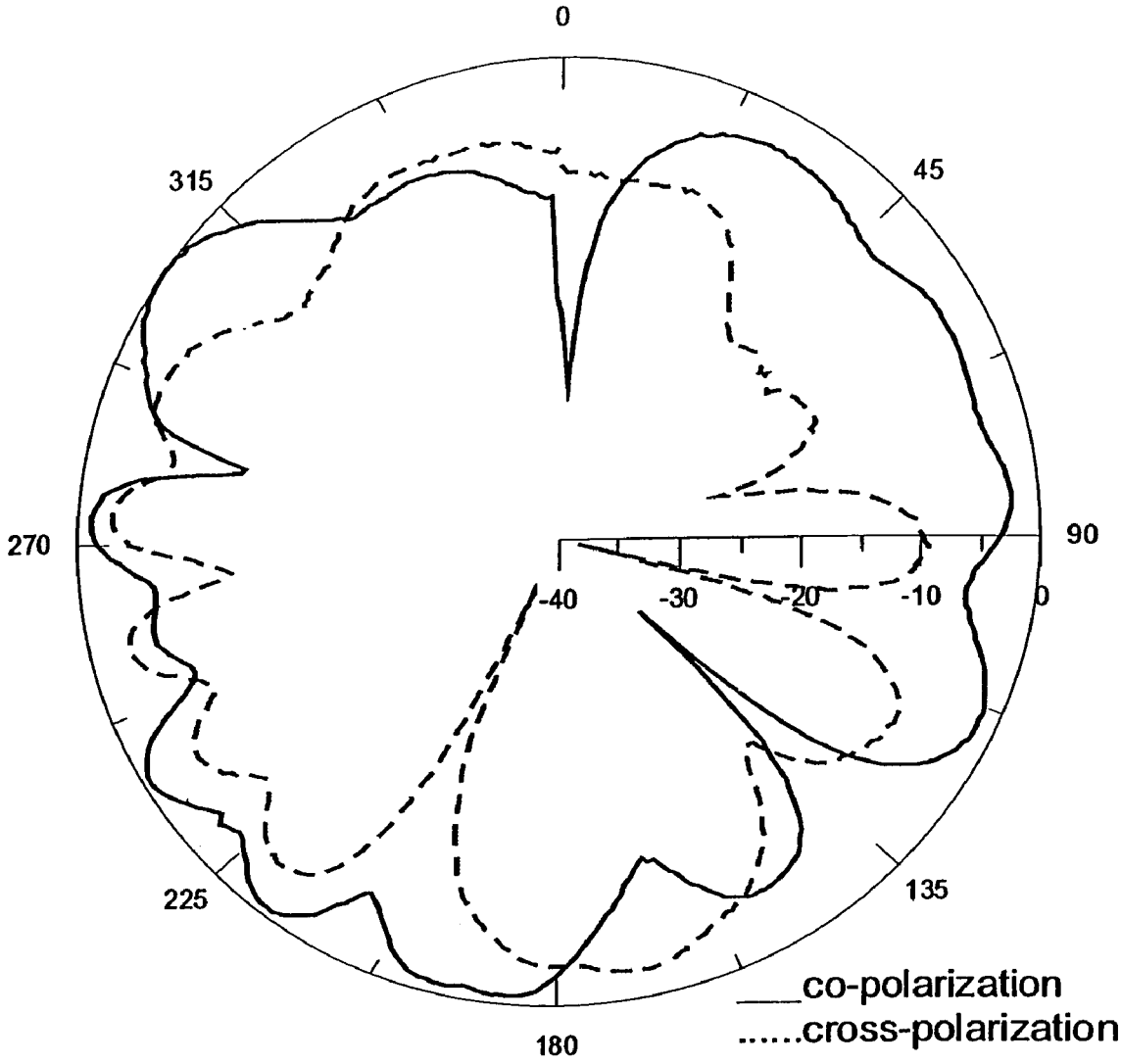
FIG. 10 shows the radiation diagram on XZ plane at 5.2 GHz.
Figure 11:
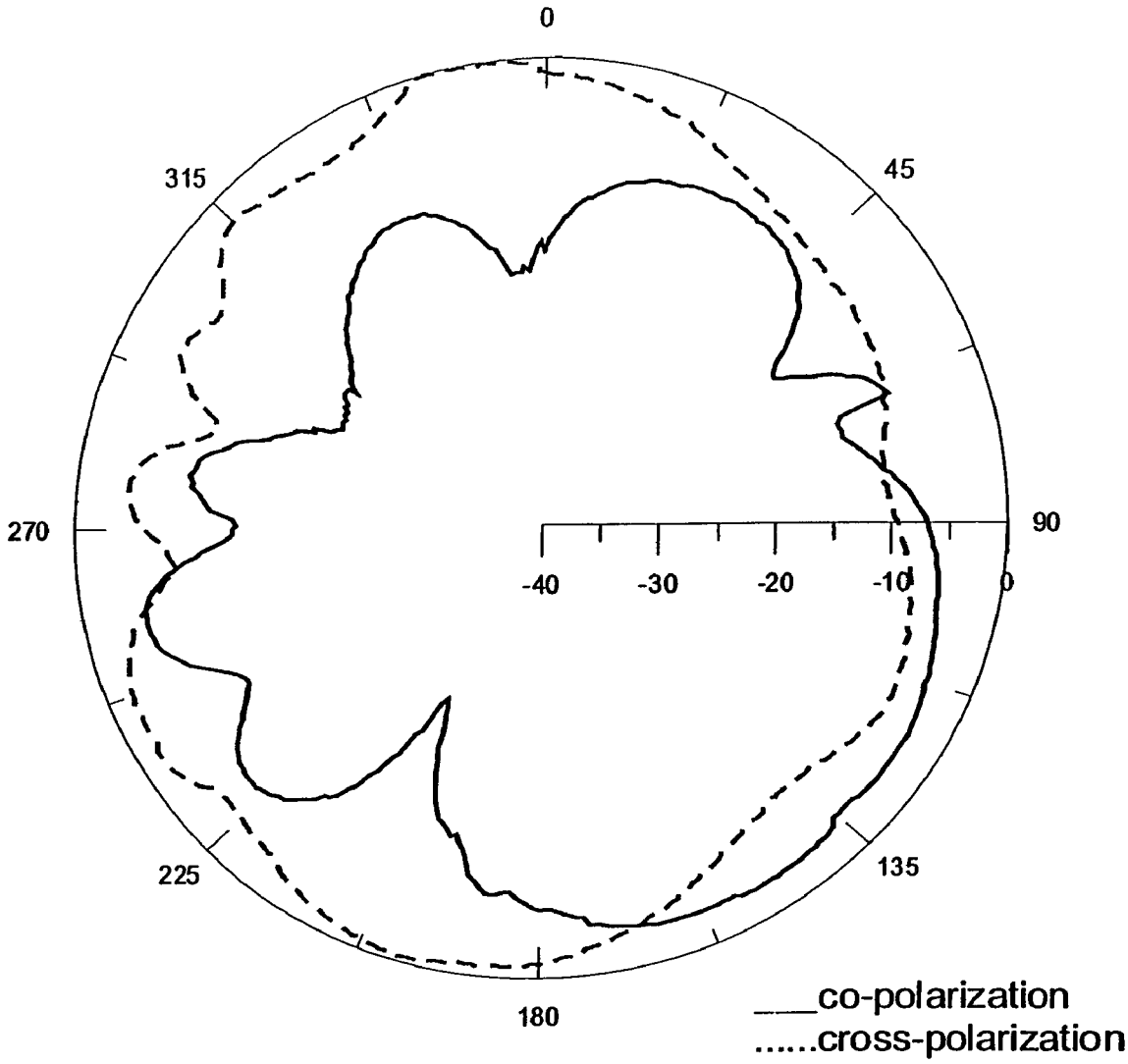
FIG. 11 shows the radiation diagram on XY plane at 5.2 GHz.
Figure 12:
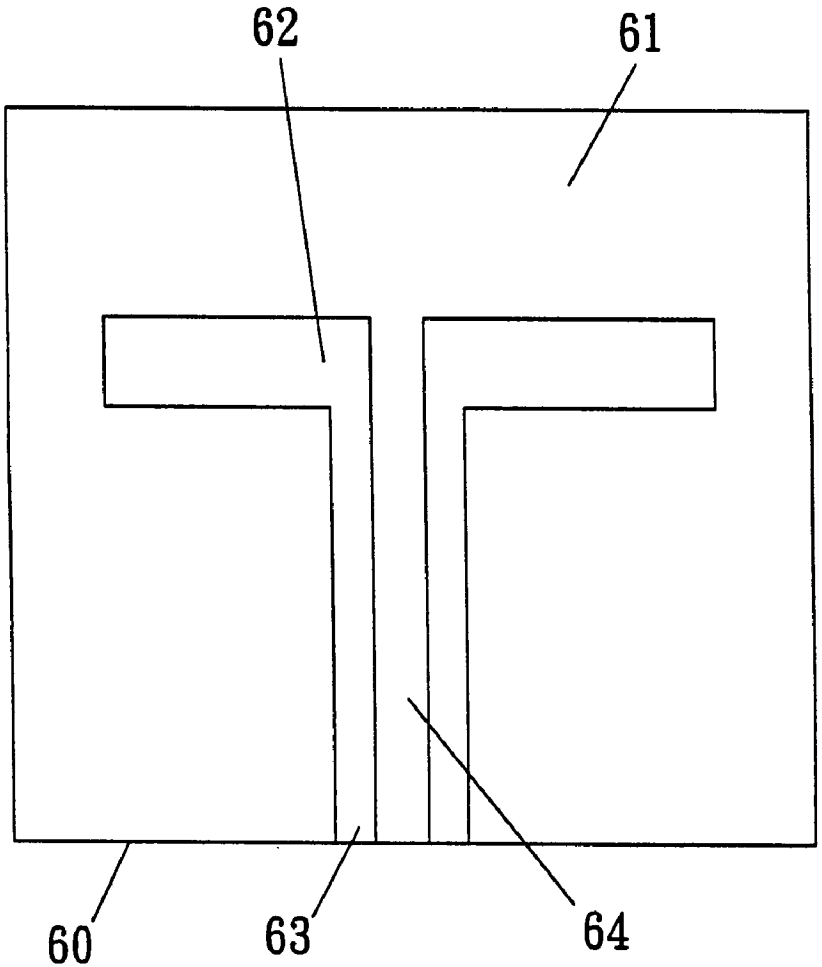
PRIOR ART FIG. 12
FIG. 12 shows a conventional slot antenna.
Figure 13:
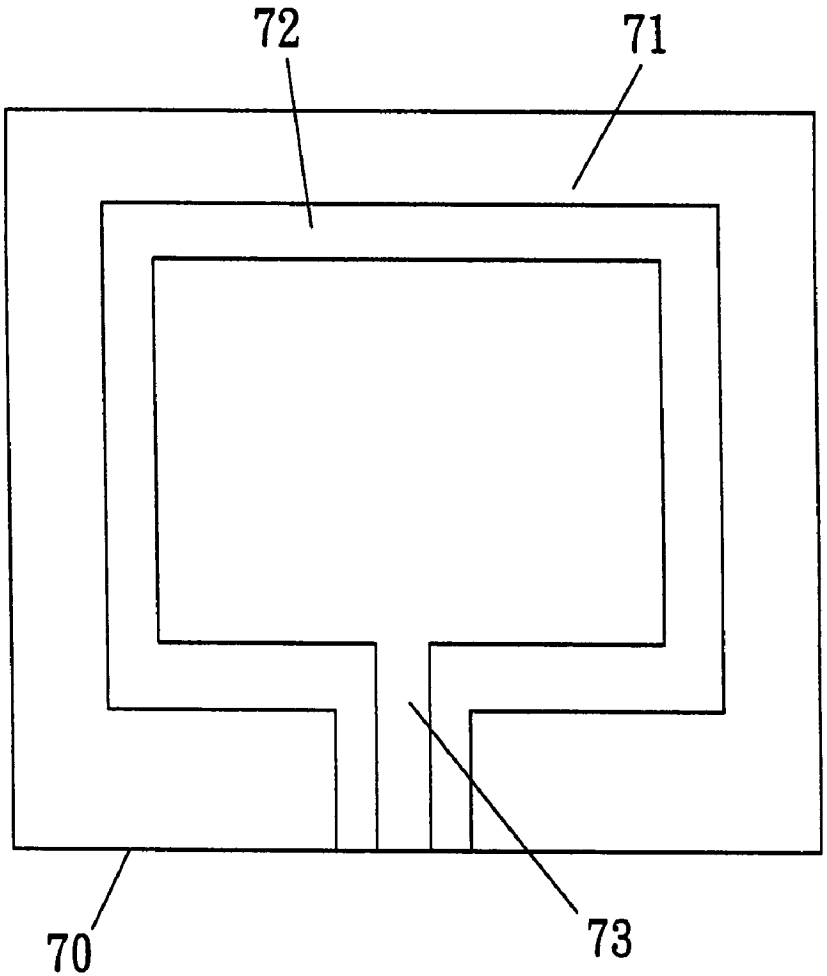
PRIOR ART FIG. 13
FIG. 13 shows another conventional slot antenna.

FIG. 8 discloses the changes of co-polarization and cross-polarization on the XZ planes at the frequency of 2.45 GHz. FIG. 9 discloses the changes of co-polarization and cross-polarization on the XY planes at the frequency of 2.45 GHz. FIG. 10 discloses the changes of co-polarization and cross-polarization on the XZ planes at the frequency of 5.2 GHz. FIG. 10 discloses the changes of co-polarization and cross-polarization on the XY planes at the frequency of 5.2 GHz.

While we have shown and described the embodiment in accordance with the present invention, it should be clear to those skilled in the art that further embodiments may be made without departing from the scope of the present invention.

The invention claimed is:

1. A slot antenna comprising:

a substrate (10) having a metal ground plate (20) on one side thereof and a plurality of rectangular slots (40) etched in an inner periphery of the ground plate (20), an opening (21) defined in one side of the ground plate (20) and a metal feedline (30) located on the substrate (10) and located close to the opening (21), the feedline (30) including a plurality of sub-sections extending within the slots (40), at least two matching stubs (31, 32, 33) formed on the feedline (30) and a sub-ground plate (22) connected to the ground plate (20) and located in the slot (40), a plurality of metal floating stubs (50, 51, 52, 53) attached to a rear side of the substrate (10), the projection of the floating stubs (50, 51, 52 and 53) connected across the ground plate and at least one of the matching stubs (31, 32, 33) of the feedline (30) when viewing from a front side of the substrate (10).

2. The slot antenna as claimed in claim 1, wherein the feedline (30) includes a first section, a second section and a third section, the second section (301) located at negative 90 degrees (counter clockwise) relative to the first section (300), the third section (302) located at positive 90 degrees (clockwise) relative to the second section (301), the number of said matching stubs (31, 32, 33) is three, the first matching stub (31) extending from a bending portion of a beginning point (303) of the feedline (30), the second matching stub (32) extending from the third section (302) and the third matching stub (33) extending from the distal end of the third section (302), a gap defined between the sub-ground plate (22) and the third section (302).

3. The slot antenna as claimed in claim 1, wherein a fourth matching stub (34) extends from a distal end of the third section (302) and is located in opposite to the third matching stub (33).

4. The slot antenna as claimed in claim 1, wherein a metal plate (35) is disposed on a conjunction portion of the first section (300) and second section (301) so as to be used as an impedance transformer to reduce frequency.

5. The slot antenna as claimed in claim 4, wherein the floating stub (53) is attached to the rear side of the substrate (10), and when viewed from the front side of the substrate (10), the projection of the floating stub (53) connected across the ground plate (20) and the metal plate (35).

6. The slot antenna as claimed in claim 1 wherein the plurality of metal floating stubs comprise four floating stubs (50, 51, 52 and 53) attached on the rear side of the substrate (10), when viewed from the front side of the substrate (10), the projection of the first floating stub (50) connected across the second, the third, the fourth matching stubs (32, 33, 34) and the ground plate (20), the projection of the second floating stub (51) connected across the second matching stub (32), the second and third sections (301, 302) and the ground plate (20), the projection of the third floating stub (52) connected across the first and second matching stubs (31, 32), the sub-ground plate (22) and the ground plate (20).

* * * * *